US007270583B1

(12) United States Patent
Yeun-Junn

(10) Patent No.: US 7,270,583 B1
(45) Date of Patent: Sep. 18, 2007

(54) HIGH EFFICIENCY WATERCRAFT PROPULSION SYSTEM

(75) Inventor: Lin Yeun-Junn, Taichung (TW)

(73) Assignee: Solas Science & Engineering Co., Ltd, Taichung (TW)

( * ) Notice: Subject to any disclaimer, the term of this patent is extended or adjusted under 35 U.S.C. 154(b) by 0 days.

(21) Appl. No.: 11/563,714

(22) Filed: Nov. 28, 2006

Related U.S. Application Data

(60) Provisional application No. 60/806,801, filed on Jul. 10, 2006.

(51) Int. Cl.
*B63H 11/00* (2006.01)

(52) U.S. Cl. ..... 440/38; 440/68

(58) Field of Classification Search ..... 440/38, 440/68

See application file for complete search history.

(56) References Cited

U.S. PATENT DOCUMENTS 3,659,547 A 5/1972 Stuart
5,123,867 A * 6/1992 Broinowski ..... 440/42
5,700,169 A * 12/1997 Jones ..... 440/46
6,132,269 A * 10/2000 Belt ..... 440/38

FOREIGN PATENT DOCUMENTS

GB 2 248 433 A 4/1992

* cited by examiner

*Primary Examiner*—Stephen Avila
(74) *Attorney, Agent, or Firm*—Ronald E. Smith; Smith & Hopen, P.A.

(57) ABSTRACT

A propulsion system for a watercraft includes a concavity formed in a hull of the watercraft. The concavity has a minimum depth at its leading end and a maximum depth at its trailing end. An impeller is mounted in the trailing end of the concavity and a stator trails the impeller. A nozzle having a radius only slightly less than a radius of the impeller is disposed in trailing relation to the stator. An elongate drive shaft extends from an engine mounted fore of the concavity to the impeller. An intake grate is disposed in a mouth of the concavity. Water flowing through the intake grate flows through the concavity in a laminar flow and encounters no obstacles other than the elongate drive shaft before encountering the impeller.

7 Claims, 13 Drawing Sheets

HIGH EFFICIENCY WATERCRAFT PROPULSION SYSTEM

CROSS REFERENCE TO RELATED APPLICATIONS

This application claims priority to currently pending U.S. Provisional Patent Application 60/806,801, entitled, "High Efficiency Watercraft Propulsion System", filed Jul. 10, 2006, the contents of which are herein incorporated by reference.

BACKGROUND OF THE INVENTION

1. Field of Invention

This invention relates to impeller-driven watercraft having a concavity formed in the hull of the watercraft for accommodating the impeller so that the impeller operates at high efficiency.

2. Description of the Prior Art

A conventional watercraft equipped with an inboard engine has a downwardly-inclined elongate drive shaft that interconnects the output shaft of the engine and a propeller. A water-tight opening is formed in the hull so that the elongate drive shaft can extend therethrough. A support strut depends from the bottom of the hull and a housing at the lower end of the strut receives the elongate drive shaft. The propeller is positioned on the trailing side of the housing, at the trailing end of the elongate drive shaft. An inboard or outboard-mounted rudder trails the propeller.

This well-known arrangement of parts results in a low efficiency watercraft because most of the elongate drive shaft and all of the other parts, i.e., the strut, the housing, the propeller and the rudder are all mounted below the hull of the watercraft, thereby creating drag. The propeller and other exposed parts are also subject to damage by submerged rocks and the like.

Inventors have therefore improved the conventional design by forming a tunnel in the hull, at the stern end thereof, in the form of a concavity, and positioning the aforesaid parts in the tunnel. This enables the elongate drive shaft to be positioned in a horizontal plane or nearly in a horizontal plane. An example of such a watercraft is disclosed in co-pending U.S. patent application Ser. No. 10/855,569 to the present inventor. Further examples are disclosed in U.S. Pat. No. 3,659,547 to Stuart and in U.K. patent application No. 2,248,433 to Renato Levi Limited. This arrangement of parts reduces drag so that the engine operates at higher efficiency. The parts in the tunnel are also protected from damage by submerged objects. A twin engine watercraft is provided with two tunnels, equidistantly spaced on opposite sides of the longitudinal axis of symmetry of the watercraft.

An intake grate extends over the mouth of each tunnel to admit water but not debris into the concavity.

The use of a stator in conjunction with a propeller also increases the efficiency of the propeller. A propeller, when encircled by a housing having a diameter only slightly greater than the diameter of the propeller, becomes an impeller by definition.

Although watercraft having at least one tunnel formed in the hull operate at higher levels of efficiency than watercraft lacking such tunnel or tunnels, there remain a few areas where such watercraft could be improved.

For example, at high speeds air can be entrained into the tunnel. Specifically, air flows along the top of the tunnel so that the tunnel is not full of water. The air causes turbulence within the tunnel as it mixes with water as it flows through the impeller. A laminar flow through an impeller is more desirable than a turbulent flow because in a laminar flow, only water flows through the impeller. Thrust is lost when air flows through an impeller.

Thus there is a need for an improved tunnel design that inhibits the formation of airflow through the tunnel. Such an improved design would produce a high efficiency laminar flow through the impeller.

Tunnel designs are also known where a nozzle has a diameter that is only about half the diameter of the impeller. Such reduced-diameter nozzles are commonly provided in watercraft propulsion systems that harness the power created by the action and reaction characteristics of a jet. This reduces engine efficiency by creating a substantial back pressure.

Thus there is a need for a propulsion system that does not rely upon jet propulsion characteristics so that the nozzle may have a large diameter relative to impeller diameter, thereby reducing back pressure and increasing engine efficiency.

The bow of a high-performance boat tends to lift up from the water and the stern thereof tends to enter more deeply into the water at high speeds.

There is a need, therefore, for a boat design that inhibits bow-lifting and stern-deepening.

SUMMARY OF INVENTION

The long-standing but heretofore unfulfilled need for an improved watercraft propulsion system that fulfills the identified needs is now met by a new, useful, and nonobvious invention. The inventive structure includes a tunnel that defines a concavity formed in a hull of the watercraft. The concavity has a longitudinal axis of symmetry coincident with a longitudinal axis of symmetry of the watercraft. The concavity has a trailing end coincident with the transom or trailing edge of the watercraft and has a leading end disposed forwardly of the transom. The concavity has a minimum depth at its leading end and a maximum depth at its trailing end.

An impeller and a stator are mounted in the trailing end of the concavity with the stator disposed in trailing relation to the impeller. A first cylindrical housing closely encircles the impeller and a second cylindrical housing closely encircles the stator. An engine having an output shaft is positioned forwardly of the concavity. An elongate drive shaft extends in a substantially horizontal plane from the output shaft to the impeller or it may be angled downwardly at any angle between zero to five degrees (0-5°).

A top wall of the concavity or tunnel is sloped at an angle between twenty to thirty degrees (20-30°). This ensures that no air pockets are formed in the cavity along said top wall, even when the watercraft is traveling at high speeds. Water therefore flows through the concavity in a laminar flow. In addition, the respective diameters of hubs of the stator and the impeller are about 15-20% of the radii of the stator and the impeller. This design conforms to the typical axial-flow model, so that the flow rate is increased to further enhance the performance of the impeller. The stator associated with the impeller also enhances such performance.

The top wall of the concavity, which is provided at two lateral sides thereof with two curved sections respectively integrally connected with two opposite side walls of the concavity, is substantially flat near the leading end of the concavity and gradually increases in curvature toward the trailing end of the concavity, that is, the flat section between the two curved sections of the top wall gradually diminishes from the leading end of the concavity toward the trailing end of the concavity. The top wall of the concavity has a substantially semicircular shape that accommodates the impeller and impeller housing and the stator and stator housing at its trailing end. The radius of the concavity at its trailing end is slightly greater than a common radius of said impeller and stator.

A nozzle is disposed in trailing relation to the stator. It has a radius about 15-20% less than the radius of the concavity so that it presents little back pressure to the engine. In general, the combination of the impeller, stator and nozzle may be referred to as an eductor-jet pump or simply a pump.

A deflector is positioned in the concavity in leading relation to the impeller. Whereas the top wall of the concavity directs water in the top half of the concavity into the impeller, some of the water in the bottom half of the concavity could flow under the left side and the right side of the impeller because the round shape of the impeller does not conform to the relatively flat shape of the hull of the watercraft. The deflector is therefore mounted on part of the intake grate and on the bottom of the impellor housing so that water that would have passed to the left and right of the impeller near its lower half is deflected upwardly and radially inwardly into the space bounded by the cylindrical housing of the impeller.

An intake grate is disposed in the mouth of the concavity to prevent debris from clogging the impeller. Most of the water flowing through the intake grate encounters no obstacles other than the elongate drive shaft before encountering the impeller. Some of the water encounters the deflector as well but the deflector provides arcuate surfaces that do not abruptly change the direction of water flow. Therefore water flows through the impeller in a laminar flow.

In the first embodiment, the elongate drive shaft is disposed in a substantially horizontal plane as aforesaid and is coupled to an output shaft of the engine. The concavity has a depth at its trailing end sufficient to accommodate the impeller such that a central hub of the impeller is positioned at an elevation substantially equal to an elevation of an output shaft of the engine.

The nozzle has a diameter only slightly less than a diameter of the circular housing that circumscribes the impeller. Engine efficiency is therefore improved by a low back pressure presented by the nozzle.

A rectangular-in-configuration trim adjustable ride plate has a width about one and a half times larger than the diameter of the impeller. The ride plate has a leading end fixedly mounted on the bottom of the impeller housing and connected to the intake grate trailing end. The middle area of the ride plate is mounted on the nozzle front ring near the stator. It is located under the pump and in trailing relation to the bottom of the tunnel.

The longitudinal axis of the trim adjustable ride plate is coincident with the longitudinal axis of the hull. Since the leading end of the trim adjustable ride plate is stationary and the trailing end of the trim adjustable ride plate can be adjusted to a downwardly inclined position, the lift caused by the trim adjustable ride plate will lift the stern of the watercraft and lower, accordingly, the bow of the watercraft when the watercraft is in a high-speed motion. Because the concavity provided by the present invention is formed at the stern of the watercraft, which results in decrease in buoyancy of the watercraft, the stern of the watercraft tends to sink deeper into the water, especially when the watercraft is in a high-speed motion. However, this phenomenon can be modified by adjusting the incline of the novel trim adjustable ride plate. The incline of the trim adjustable ride plate is adjustable by using a plurality of washers disposed between the ride plate and the nozzle. Reducing the number of washers raises the trailing end of the trim adjustable ride plate, thereby lowering the stern and raising the bow. Increasing the number of washers lowers the trailing end of the trim adjustable ride plate, thereby raising the stern and lowering the bow. In other words, the incline of the trim adjustable ride plate is adjustable by changing the collective thickness of the washers used.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
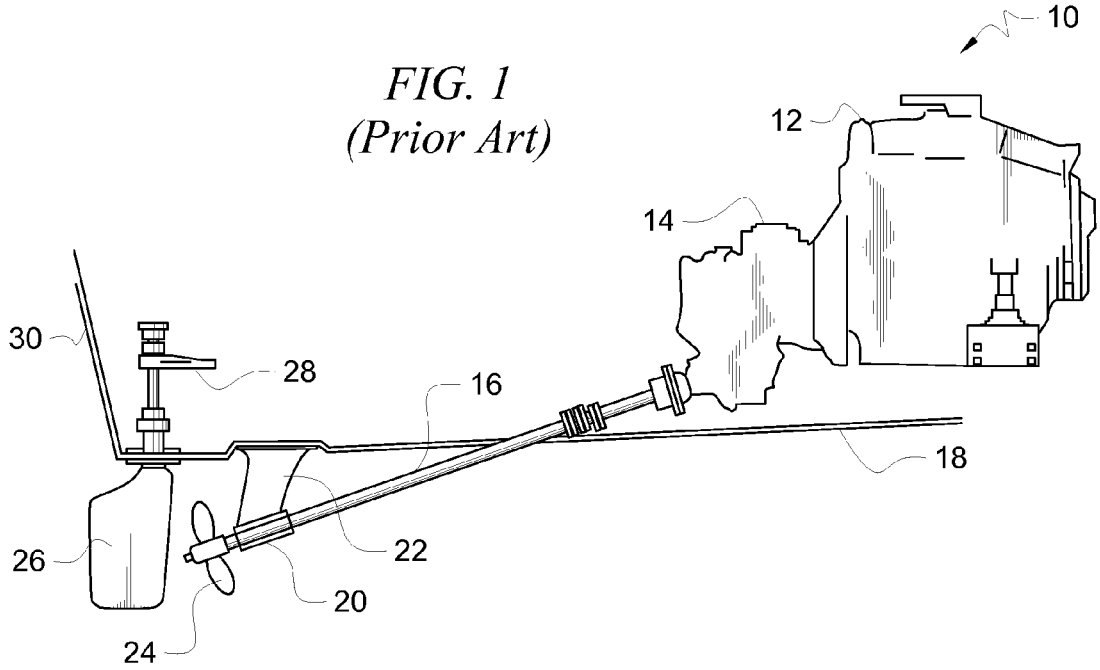
FIG. 1 (Prior Art)
FIG. 1 is a side elevational view of a prior art direct drive having an inboard rudder.

A prior art direct drive having an inboard rudder is denoted as a whole by the reference numeral 10 in FIG. 1. The assembly of parts includes engine 12, transmission 14, and downwardly-angled elongate drive shaft 16 that extends through a watertight opening formed in hull 18. The lower end of drive shaft 16 is rotatably received in cylinder 20 of strut 22 that depends from hull 18. Propeller 24 is secured to the distal end of elongate drive shaft 16 for conjoint rotation therewith. Inboard rudder 26 is controlled by tiller 28 mounted fore of transom 30.

Most of the length of elongate drive shaft 16 is thus positioned outside of hull 18 below the surface of the water, together with all of cylinder 20, strut 22, propeller 24 and rudder 26. These parts thus represent drag and lower the efficiency of engine 12. They are also in an exposed, unprotected configuration where they can be damaged by underwater rocks or other substantially immovable submerged objects.

Figure 2:
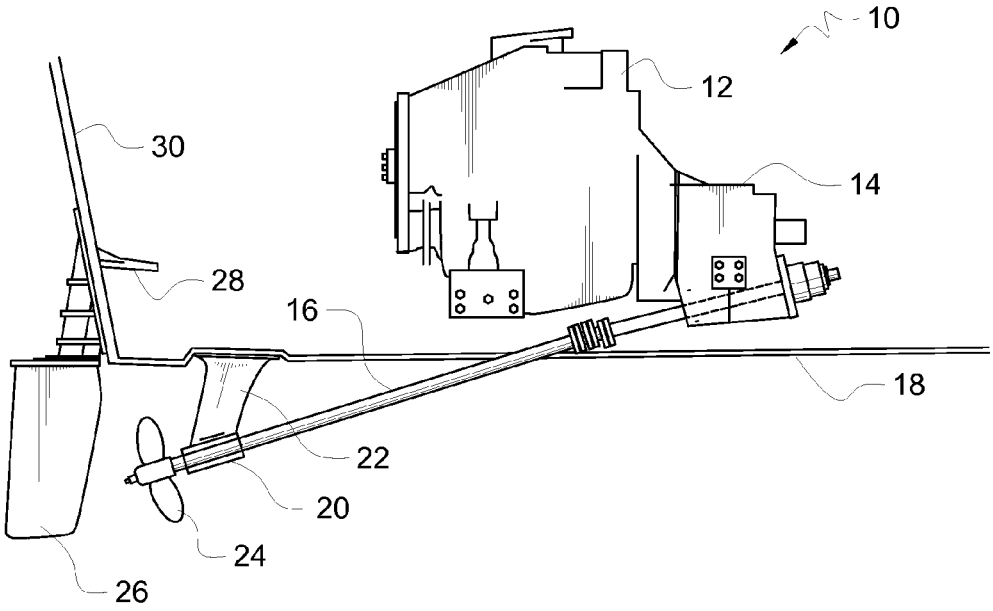
FIG. 2 (Prior Art)
FIG. 2 is a side elevational view of a prior art V-drive having an outboard rudder.

In FIG. 2, rudder 26 is mounted aft of transom 30 in this prior art V-drive having an outboard rudder 26. The same parts that produce drag in the assembly depicted in FIG. 1 also produce drag in the assembly of FIG. 2.

Figure 3:
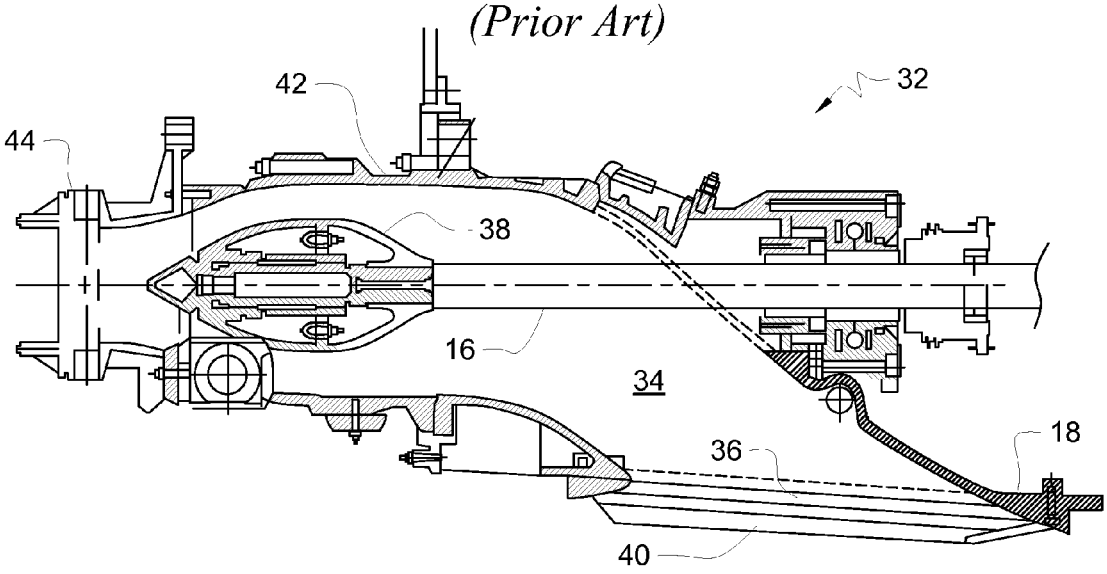
FIG. 3 (Prior Art)
FIG. 3 is a longitudinal sectional view of a prior art water jet propulsion system.

Prior art FIG. 3 depicts a water jet assembly denoted 32 as a whole. Engine 12 and transmission 14 are not depicted in this view, but elongate drive shaft 16 is. Note that said elongate drive shaft 16 is horizontally disposed. A tunnel defining concavity 34 is formed in hull 18. The top wall of concavity 34 is denoted 36 and is angled upwardly relative to said hull at an angle of about forty-five degrees (45°). Impeller 38 is mounted to the distal free end of elongate drive shaft 16. Water is drawn into concavity 34 through intake grate 40 at the mouth of said concavity and flows through impeller housing 42 and then through discharge nozzle 44. Said discharge nozzle 44 has a diameter that is substantially constricted relative to the diameter of impeller housing 42. The velocity of the water therefore must increase in accordance with Bernoulli's principle as it flows through the nozzle and the reactive force caused by such acceleration propels the watercraft forwardly. More particularly, the impulse I applied to the watercraft is equal to the change in momentum $\Delta P$ in accordance with the impulse-momentum principle, i.e., $I=\Delta P$.

The advantage provided by concavity 34 is that elongate drive shaft 16 is horizontally mounted and thus does not extend below hull 18, thereby reducing drag. Moreover, impeller 38 is also above said hull, and cylinder 20 and strut 22 required to hold the distal end of elongate drive shaft 16 in the first two prior art embodiments discussed above are eliminated, thereby decreasing drag still further. The parts in the concavity are also protected from damage caused by submerged rocks and the like. The drawbacks of water jet 32 include the relative inefficiency of the jet propulsion method, attributable at least in part to the back-pressure presented by constricted discharge nozzle 44. Further drawbacks include the turbulent flow of water past impeller 38, caused primarily at high speeds by air pockets that develop in concavity 34.

Figure 4:
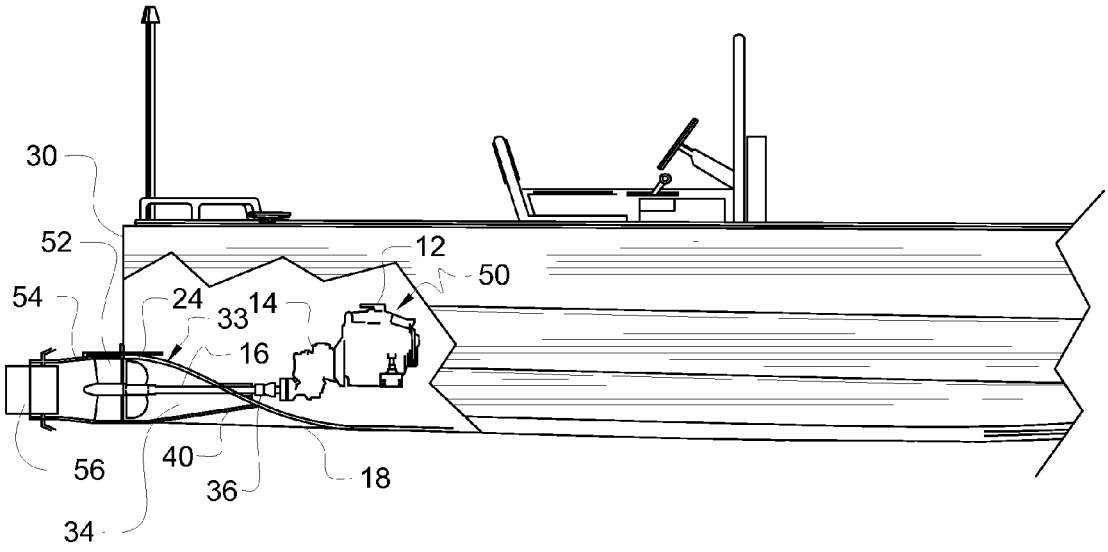
FIG. 4 is side elevational, diagrammatic view of a marine diesel or gasoline engine having an in-line propulsion system.

Referring now to FIG. 4, it will there be seen that an illustrative embodiment of the invention is depicted in diagrammatic form and is denoted 50 as a whole. This inline system for a marine diesel or gasoline engine includes engine 12, transmission 14, and horizontally-disposed elongate drive shaft 16 having impeller 24 mounted to the distal free end thereof for conjoint rotation therewith. Tunnel member 33 is preferably made of the same material as the hull, such as fiberglass reinforced plastic, aluminum alloy, or stainless steel. Tunnel 33 defines concavity 34 and has an interior top wall 36. Said top wall is disposed at a less severe angle than the top wall of prior art concavities. Intake grate 40 covers the opening or mouth of concavity 34. Non-rotating stator 52 is positioned aft of impeller 24 and aft of transom 30, as are nozzle 54 and rudder 56. However, all of said parts are positioned above hull 18 to minimize drag and to protect them from damage.

As used herein, the term "engine" includes all types of engines, electric motors, and other sources of power. In the claims that follow, the term "engine" shall therefore be construed as including all types of engines, electric motors, and other sources of power.

Figure 5:
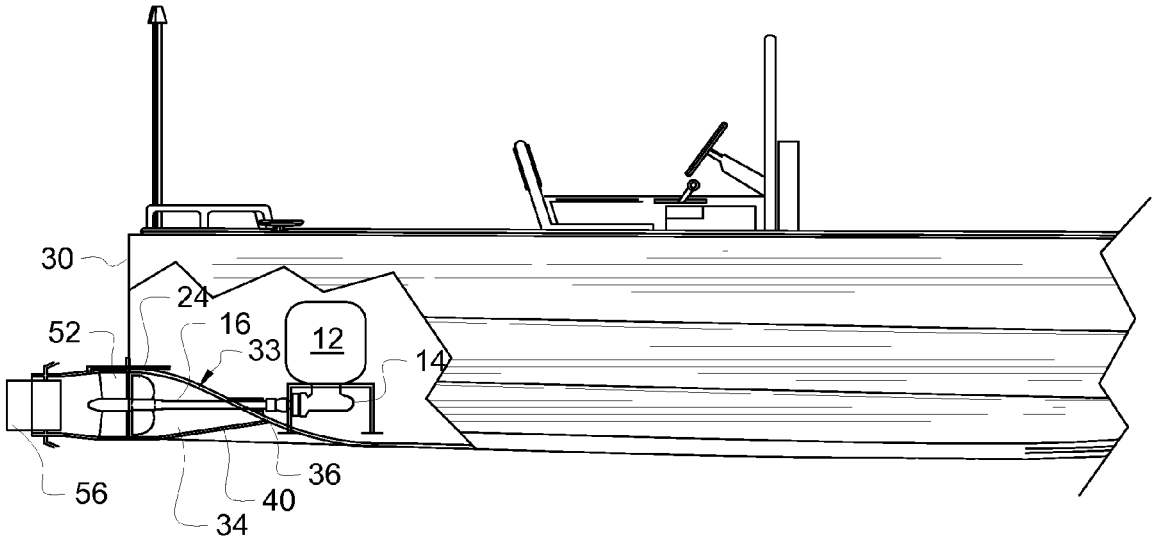
FIG. 5 is a side elevational, diagrammatic view of an outboard engine head having a ninety degree (90°) propulsion system.

FIG. 5 diagrammatically depicts a ninety degree (90°) system having utility in connection with an outboard engine head. The ninety degrees (90°) refers to the angle between the vertically disposed output shaft of outboard engine head 12 and horizontally disposed elongate drive shaft 16. This embodiment is depicted to demonstrate the versatility of the novel system.

Figure 6:
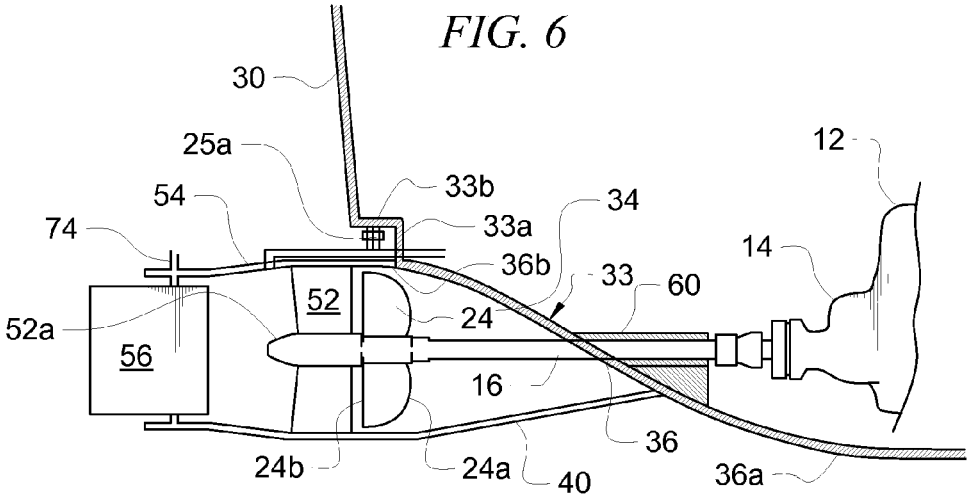
FIG. 6 is a side elevational, enlarged view of the parts depicted in FIG. 4.

FIG. 6 depicts the structure of the FIG. 4 apparatus in greater detail. Interior top wall 36 of concavity 34 is inclined at an angle of twenty four degrees (24°) relative to a horizontal plane in this embodiment. However, the range of inclination may be between twenty to thirty degrees (20-30°). Impeller housing 25 is of cylindrical configuration and circumscribes impeller 24 and stator housing 53, also of cylindrical configuration, circumscribes stator 52. Flange 25*a* circumscribes and extends radially outwardly of impeller housing 25 and is positioned between the leading or fore and trailing or aft ends of said impeller housing.

The leading end of interior top wall 36 is denoted 36*a* and the trailing end of said interior top wall is denoted 36*b*. The trailing end of tunnel member 33 is adapted to slidingly ensleeve the leading end of impeller housing 25 and to engage transom 30. The trailing end of tunnel 33 therefore has a step formed therein that includes vertical rise 33*a* and horizontal tread 33*b* to accommodate flange 25*a* that circumscribes impeller housing 25. Significantly, the trailing end 36*b* of top wall 36 has a semicircular configuration, i.e., it conforms to the shape of the upper half of impeller housing 25. As depicted in FIGS. 12-18, top wall 36 defines two symmetrical curved sections, collectively denoted 36*c*, at two lateral sides thereof and a flat section between the two curved sections 36*c*. The radius of curvature of the curved sections gradually increases from leading end 36*a* of the top wall toward the trailing end 36*b* of top wall 36. In contrast, the flat section of the top wall gradually diminishes in width to zero from leading end 36*a* of the top wall toward trailing end 36*b* of top wall 36. That is, trailing end 36*b* of the top wall has a semicircular cross-section as aforesaid. In addition, the radius of the top wall at its trailing end is slightly greater than a common radius of impeller 24 and stator 52 for enabling the trailing end of the concavity to accommodate impeller 24 and stator 25.

Impeller 24 includes a plurality of blades. The leading edge of said blades is denoted 24*a* and the trailing edge is denoted 24*b*. Trailing edge 24*b* is substantially flush with the trailing end of concavity 34. The semicircular upper part 36*a* of top wall 36 receives the upper half of impeller housing 25 and a semicircular lower wall 37 extends around the lower half of said impeller. Thus, the semicircular top half of top wall 36 and semicircular bottom wall 37 collectively circumscribe impeller housing 25.

Stator 52 includes a plurality of non-rotating vanes circumscribed by cylindrical housing 53. In a two hundred horsepower (200 hp) engine, impeller 24 has four (4) rotating blades and stator 52 has eight (8) non-rotating vanes. Cone 52*a* helps maintain a laminar flow of water through stator 52. The leading end of nozzle 54 is flanged as is the trailing end of stator housing 53 as aforesaid and the respective flanges are bolted to one another in a well-known way. The leading end of stator housing 53 is flanged as at 53*a* in FIG. 6 and said flange 53*a* is engaged to the exterior of transom 30 as depicted.

Nozzle 54 provides a housing for conventional rudder 56. Flap 57 is commercially available and enhances the effectiveness of rudder 56 at slow speeds. Significantly, the diameter of nozzle 54 at its trailing end is almost as great as the diameter of concavity 34 at its greatest diameter. In this embodiment, there is a diminution in diameter of only about five to fifteen percent (5-15%). This reduces the amount of back pressure represented by said nozzle relative to the jet nozzles mentioned above.

Intake grate 40 is mounted in the opening or mouth of concavity 34. It performs the functions of admitting water into concavity 34 and straining out debris that might foul impeller 24. It is positioned at about a twenty degree (20°) angle relative to horizontal.

If debris gets past intake grate 40 and accumulates to the extent that removal is required, access into concavity 34 is provided by access window 41. Bolts 41*a* hold said window in its closed configuration when no access is required.

Figure 7:
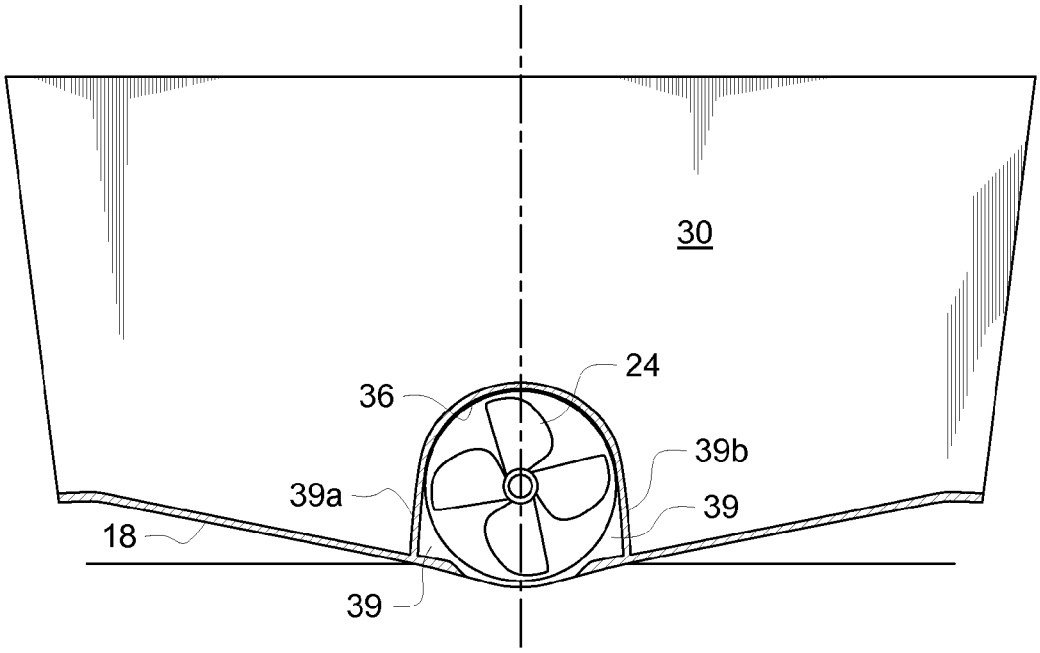
FIG. 7 is an end sectional view taken along line 7-7 in FIG. 6.
Figure 8:
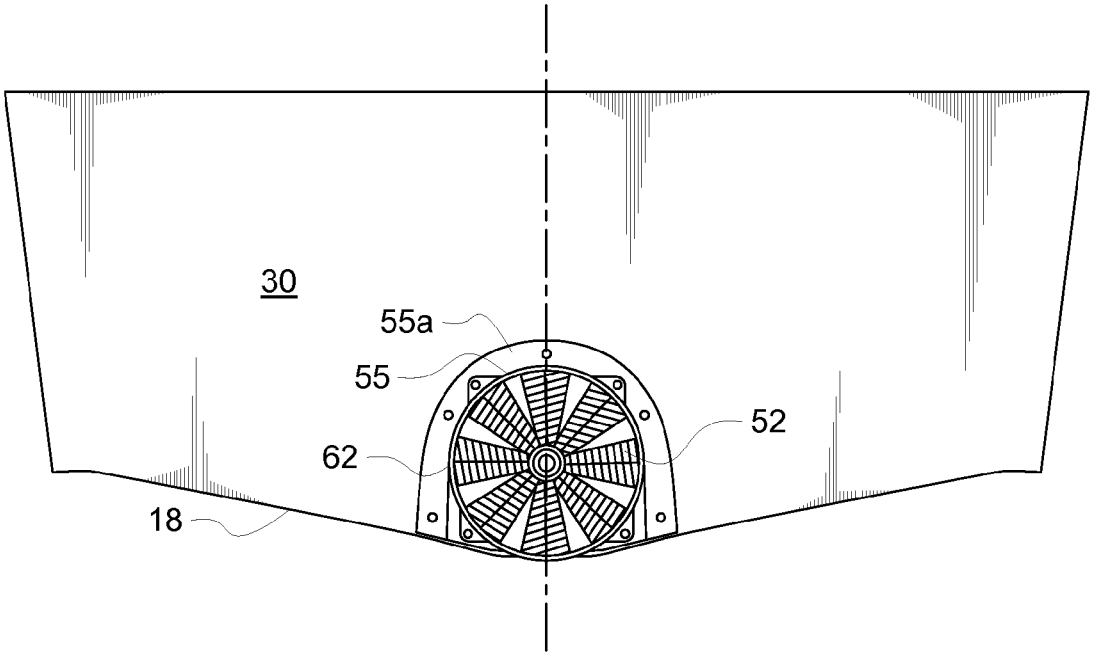
FIG. 8 is an end sectional view taken along line 8-8 in FIG. 6.
Figure 11A:
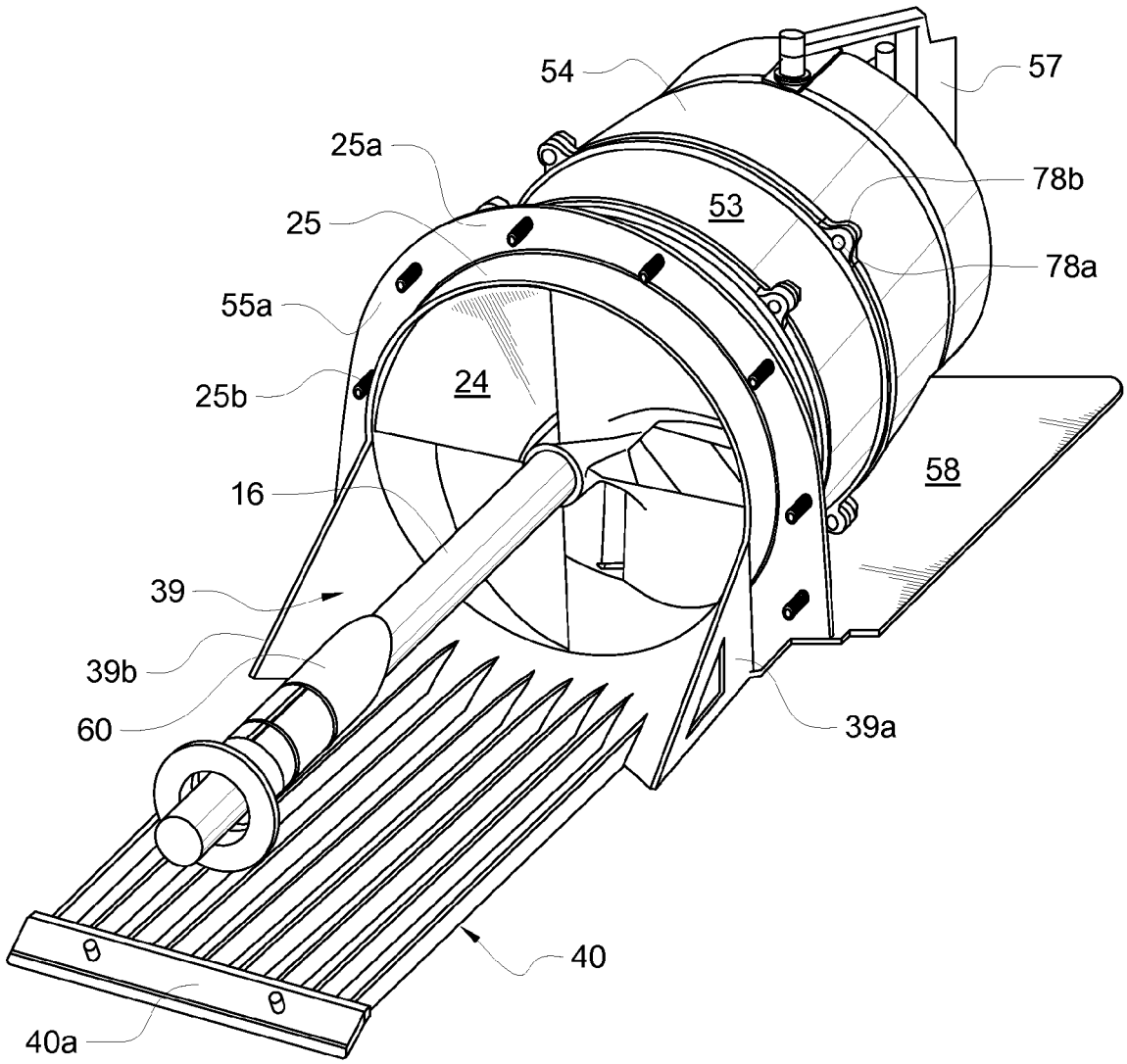
FIG. 11A a perspective view of the novel structure with the tunnel removed.
Figure 11B:
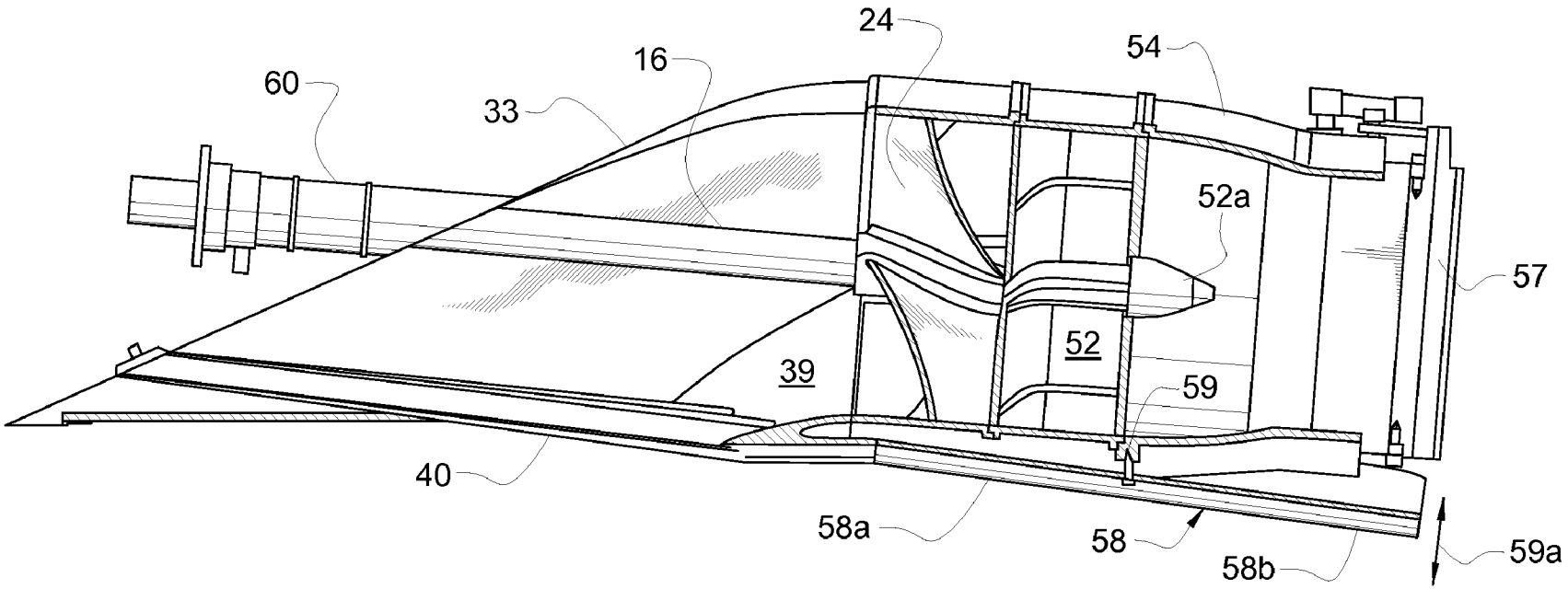
FIG. 11B is a longitudinal sectional view of the novel apparatus that depicts the trim adjustable ride plate and the means for adjusting its position.

FIG. 7 depicts the novel single engine propulsion system in end view before stator 52 is installed and FIG. 8 depicts said system after stator 52 is installed. The straight, parallel walls that apparently extend tangentially from semicircular top wall 36 are denoted 39*a*, 39*b*. Said parallel walls are the opposing lateral ends of deflector 39, the structure of which is best understood in connection with FIGS. 11A and 11B. Said deflector, as depicted in said FIGS. 11A and 11B, is positioned in concavity 34 on the leading side of impeller housing 25 and prevents water from flowing under the left and right sides of impeller housing 25. Deflector 39 has arcuate walls that direct the water flowing through concavity 34 to flow through impeller housing 25 without imparting turbulence thereto.

Figure 9:
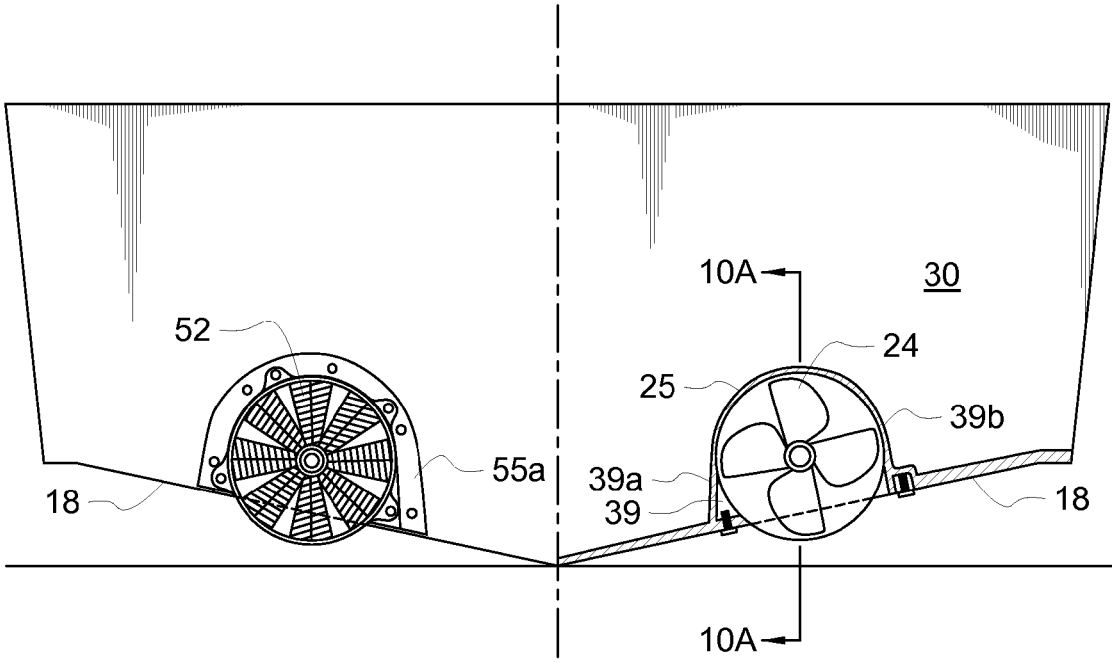
FIG. 9 is an end view of a twin engine propulsion system.

FIG. 9 depicts a twin engine embodiment, with the right side of the figure depicting the structure before the stator is attached thereto, as in FIG. 7, and the left side of said figure depicting the final installation as in FIG. 8.

Figure 10A:
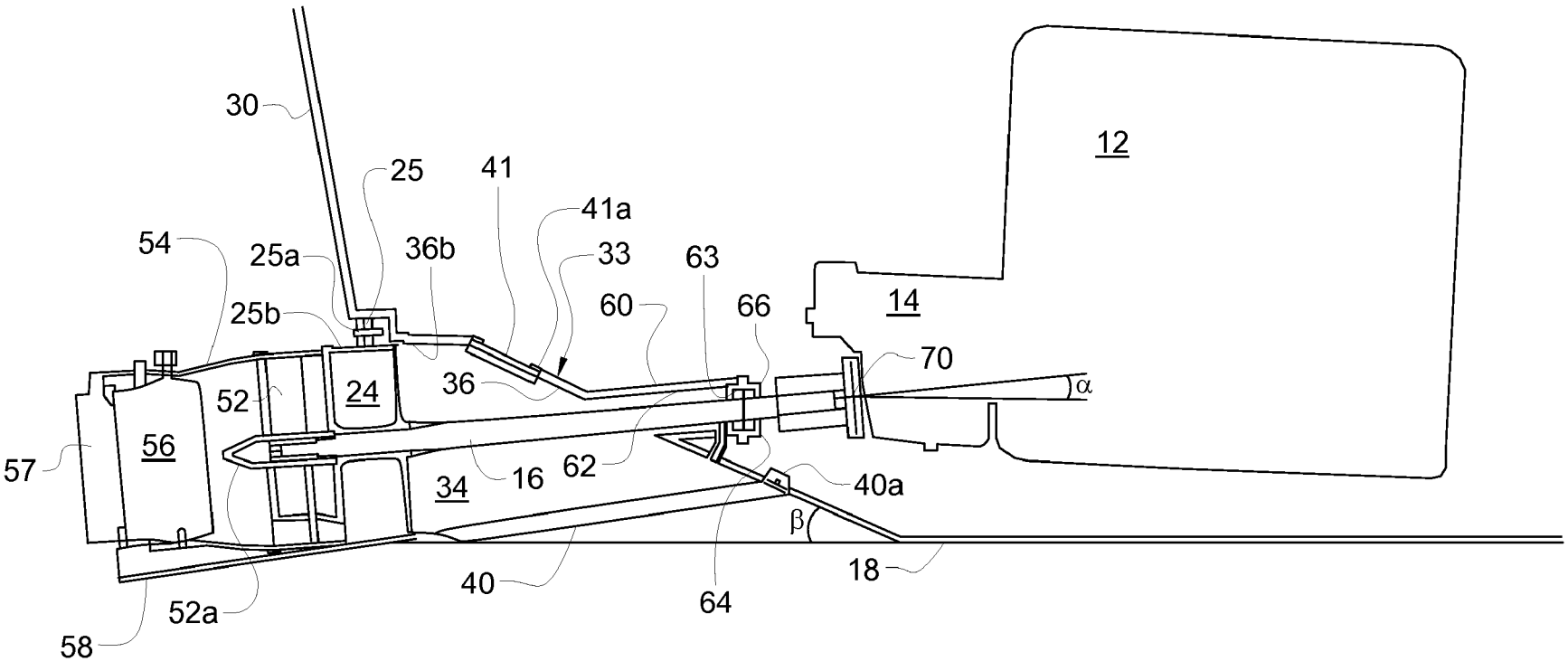
FIG. 10 is a sectional view taken along line 10-10 in FIG. 9.
Figure 10B:
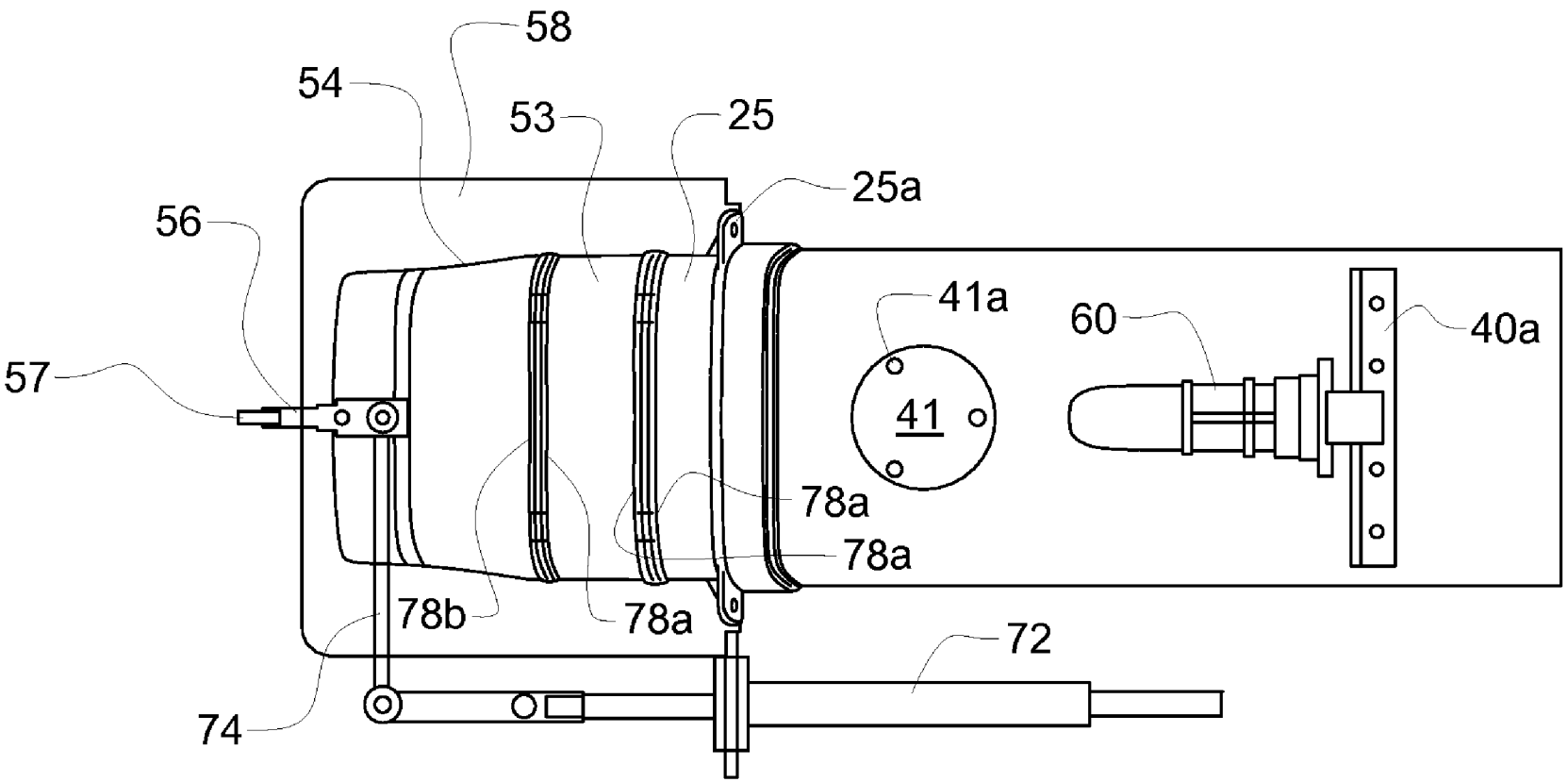

The embodiment of FIGS. 10A and 10B differs from the embodiment of FIG. 6 in that elongate drive shaft 16 is inclined downwardly from the engine to impeller 24 at an angle of about five degrees (5°). Additional structural detail is also depicted in FIGS. 10A and 10B. Stern tube 60 is formed integrally with tunnel 33 and extends therefrom at the same angle at which elongate drive shaft 16 is disposed. Cutlass bearing 62 is positioned between the cylindrical inner sidewalls of stern tube 60 and elongate drive shaft 16 so that said elongate drive shaft rotates freely about its axis of rotation within said stern tube 60. Lip seal 63 is positioned at the leading end of stern tube 60, and thrust bearing 64 abuts the leading side of said lip seal. Stopper 66 is connected to the hull structure of the watercraft and engages the leading end of thrust bearing 64. Coupler 68 includes shock-absorbing rubber lining 68*a* and couples elongate drive shaft 16 to output shaft 70 of engine 12.

Trim adjustable ride plate 58, also depicted in FIGS. 10A and 10B, has a width about fifty percent (50%) greater than the width of impeller 24 as best understood in connection with the top plan view of FIG. 10B. Said top plan view also depicts steering hydraulic cylinder 72 and the linkage 74 that interconnects said steering hydraulic cylinder to rudder 56. FIGS. 10A and 10B also depict transversely disposed mounting bar 40*a* which is positioned externally to tunnel member 33. The leading ends of the straight members that collectively form intake grate 40 are secured to said mounting bar.

FIG. 10B best depicts annular interconnecting means 76*a* formed in the trailing end of impeller housing 25 which is adapted to be secured to corresponding interconnecting means 76*b* formed in stator housing 53 at a leading end thereof. Another interconnecting means 78*a* is formed in the trailing end of stator housing 53 and is adapted to engage corresponding interconnecting means 78*b* formed in a leading end of nozzle 54.

The location and structure of deflector 39 is best understood in connection with FIG. 11A as aforesaid. Tunnel 33 is not depicted so that other parts of the structure are more easily seen. With the exception of deflector 39 and its straight sidewalls 39*a*, 39*b*, the parts identified by reference numerals in said FIG. 11A need not be pointed out again.

Figure 11C:
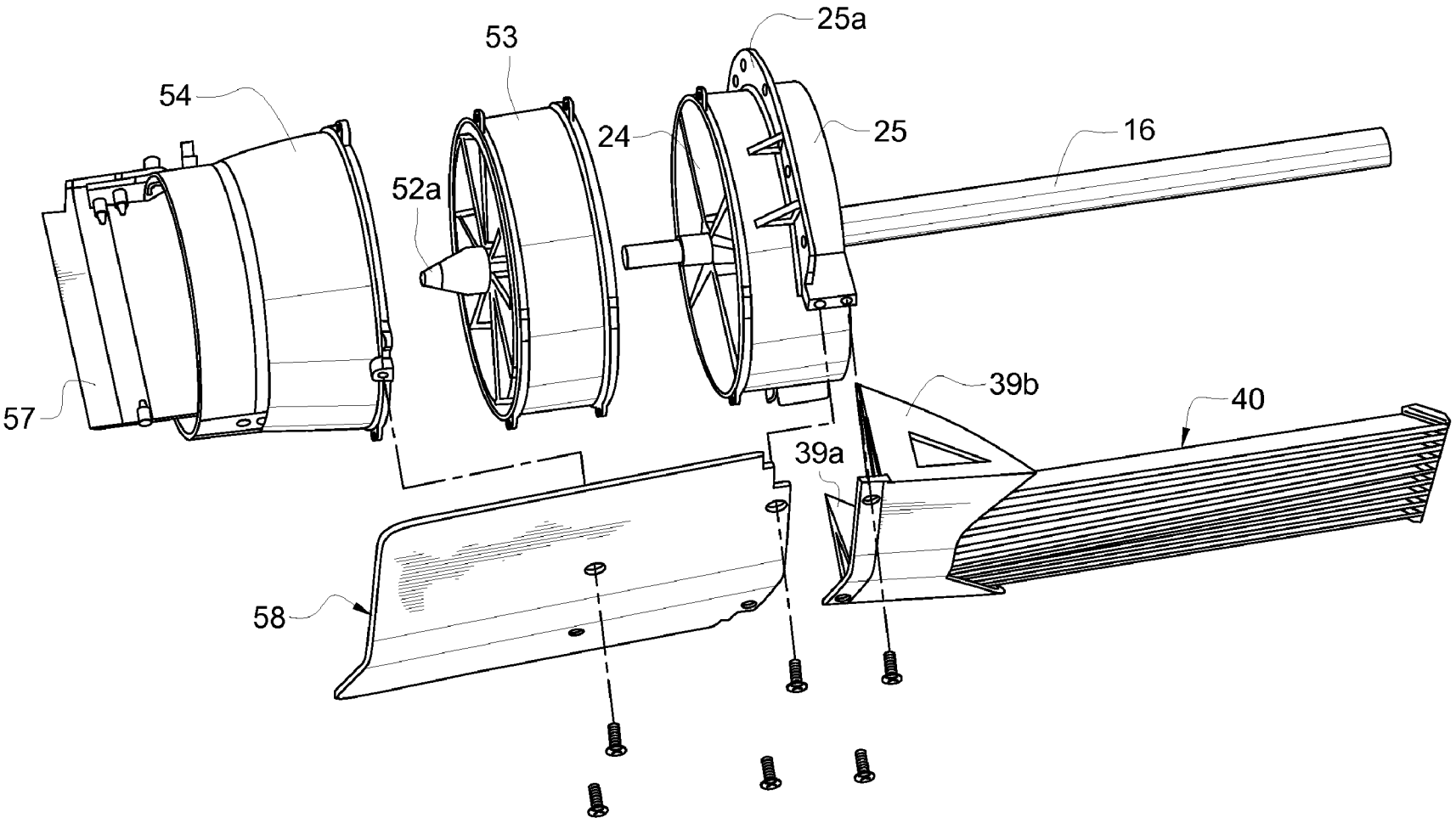
FIG. 11C is an exploded perspective view of the parts depicted in FIGS. 11A and 11B.
Figure 19:
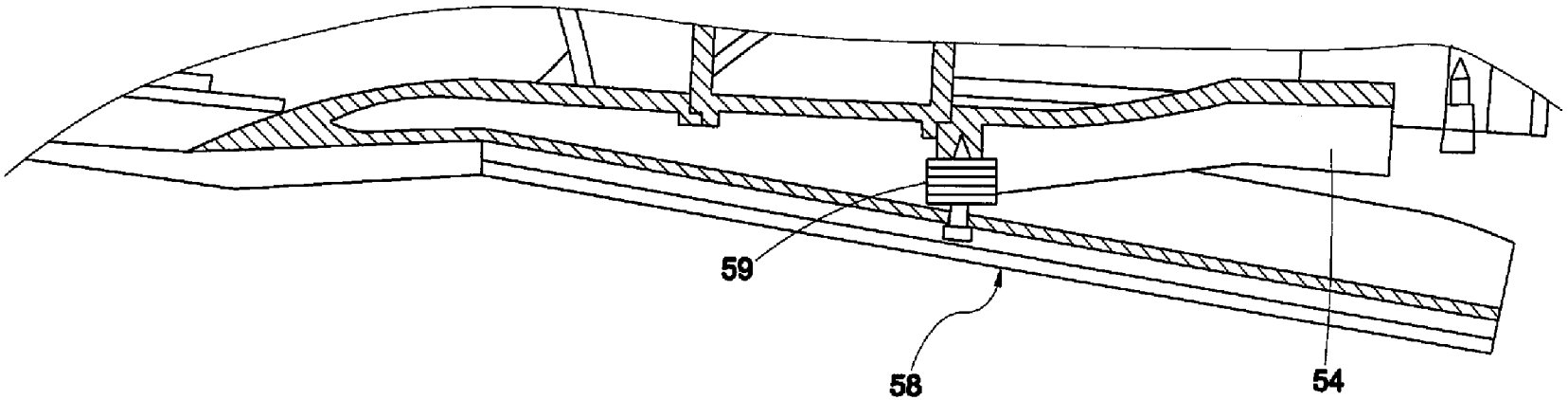
FIG. 19 is a partial sectional view showing the downward inclination of the trailing end of the trim adjustable ride plate.

Trim adjustable ride plate 58, best depicted in FIGS. 11A, 11B, and 11C, has a width about fifty percent (50%) greater than the width of impeller 24. The ride plate has a leading end fixedly mounted on the bottom of the impeller housing and connected to the intake grate trailing end. The middle area of the ride plate is mounted on the nozzle front ring near the stator. It is located under the pump and in trailing relation to the bottom of the tunnel. The longitudinal mid-point of trim adjustable ride plate 58 is coincident with the longitudinal axis of symmetry of hull 18. At high speeds, the bow of a watercraft rises relative to the water surface and the stern of said watercraft sinks deeper into the water. To counteract this drag-increasing phenomenon, trim adjustable ride plate 58 is adjusted. Specifically, its trailing end 58*b* is lowered at high speeds, thereby lifting the stern and lowering the bow to decrease drag. The adjustment is accomplished by screws and washers, collectively denoted 59 in FIG. 11B, or by other suitable adjustment means. By adjusting screws and washers 59, trim adjustable ride plate 58 is adjustable up or down as indicated by double-headed directional arrow 59*a* in FIG. 11B. As depicted in FIG. 19, as more washers are added, the inclination of lower trailing end 58*b* of trim adjustable ride plate 58 increases. In other words, the incline of trim adjustable ride plate 58 is adjustable by a collective thickness of a plurality of washers disposed between the ride plate and the nozzle. The trim adjustable ride plate protects the so-called pump, which is a combination of the impeller, stator and nozzle, from being hit. It also reduces water drag by preventing water from contacting the pump parts directly. Thus the water flow is not disturbed so that the current is smooth at the bottom of the trim adjustable ride plate.

Figure 12:
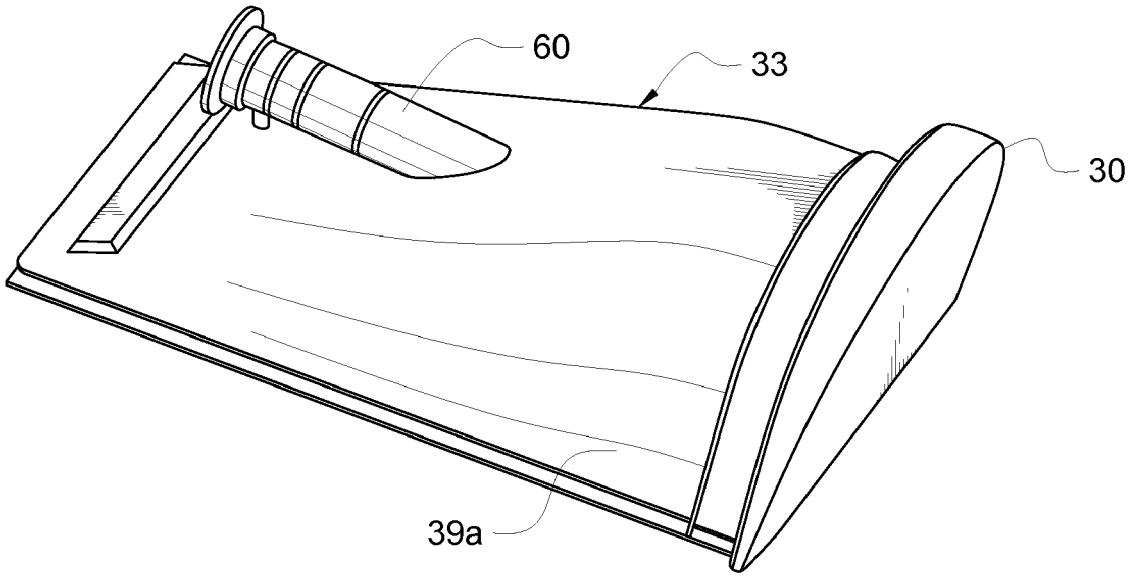
FIG. 12 is a perspective view of the novel tunnel structure.
Figure 13:
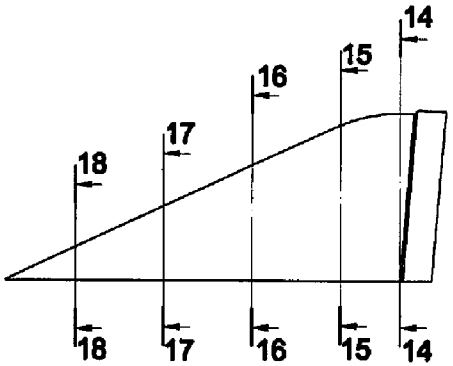
FIG. 13 is a side elevational view of the tunnel structure.
Figure 14:
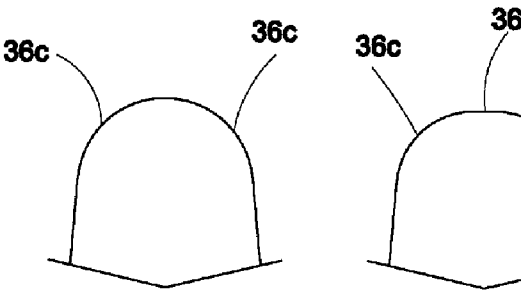
FIG. 14 is a sectional view taken along the line 14-14 in FIG. 13.
Figure 15:
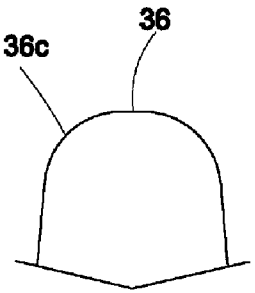
FIG. 15 is a sectional view taken along the line 15-15 in FIG. 13.
Figure 16:
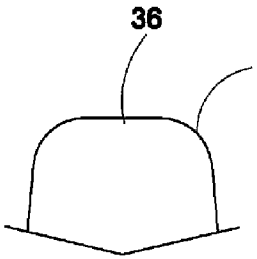
FIG. 16 is a sectional view taken along the line 16-16 in FIG. 13.
Figure 17:
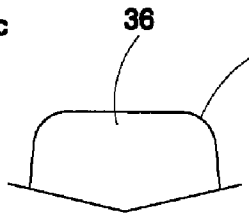
FIG. 17 is a sectional view taken along the line 17-17 in FIG. 13.
Figure 18:
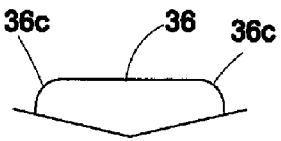
FIG. 18 is a sectional view taken along the line 18-18 in FIG. 13.

Tunnel member 33 that defines concavity 34 is depicted in isolation in FIG. 12. The parts thereof identified by reference numerals have been disclosed above.

Water flowing through intake grate 40 thus encounters only elongate drive shaft 16 and the arcuate surfaces of deflector 39 before encountering impeller 24. Due to the twenty-four degree (24°) slope of top wall 36, air pockets do not form in concavity 34. Thus, an axial or laminar flow of water flows through impeller 24, thereby increasing its efficiency relative to turbulent flow of the type provided by prior art designs.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween. Now that the invention has been described,

What is claimed is:

1. A propulsion system for a watercraft, comprising:

a tunnel formed in a hull of said watercraft, said tunnel defining a concavity having a longitudinal axis of symmetry coincident with a longitudinal axis of symmetry of said watercraft;

said concavity having a trailing end substantially coincident with a transom of said watercraft and said concavity having a leading end disposed forwardly of said transom;

said concavity having a minimum depth at said leading end and a maximum depth at said trailing end;

an impeller mounted in said trailing end of said concavity;

a stator mounted externally of said concavity in trailing relation to said impeller;

an engine positioned forwardly of said concavity, said engine having an output shaft;

an elongate drive shaft extending from said output shaft of said engine to said impeller;

a top wall of said concavity being sloped at an angle between twenty to thirty degrees (20-30°);

an intake grate disposed in a mouth of said concavity;

said top wall of said concavity being substantially flat near said leading end of said concavity and gradually increasing in curvature toward said trailing end of said concavity, said top wall of said concavity having a substantially semicircular shape at said trailing end of said concavity;

a circular housing that circumscribes said impeller, said circular housing being mounted in said trailing end of said concavity;

said stator including a plurality of non-rotatable vanes and said stator including a circular housing that circumscribes said vanes;

a nozzle disposed in trailing relation to said stator; and a rudder disposed in trailing relation to said nozzle;

whereby said slope of said top wall ensures that said concavity is completely full of water even when the watercraft is traveling at high speeds;

whereby water flowing through said intake grate encounters no obstacles other than said elongate drive shaft before encountering said impeller;

whereby water flows through said concavity in a laminar flow; and whereby said impeller, stator, and rudder are protected from damage caused by underwater obstacles.

2. The watercraft propulsion system of claim 1, further comprising:

said elongate drive shaft being disposed in a substantially horizontal plane;

said concavity at said trailing end of said concavity having a depth sufficient to accommodate said impeller such that a central hub of said impeller is positioned at an elevation substantially equal to an elevation of said output shaft of said engine.

3. The watercraft propulsion system of claim 1, further comprising:

said nozzle having a diameter only slightly less than a diameter of said circular housing that circumscribes said impeller;

whereby engine efficiency is improved by a low back pressure caused by said nozzle.

4. The watercraft propulsion system of claim 3, further comprising:

a deflector positioned in said concavity in leading relation to said impeller, said deflector adapted to cause all water flowing through said concavity to flow through said impeller housing.

5. The watercraft propulsion system of claim 4, further comprising:

a radially outwardly extending flange formed in said impeller housing;

said radially outwardly extending flange adapted to engage said transom.

6. The watercraft of claim 1, further comprising:

a trim adjustable ride plate having a leading end and a trailing end;

said trim adjustable ride plate having a rectangular configuration and having a width about fifty percent greater than a diameter of said impeller;

said leading end of said trim adjustable ride plate being fixedly mounted to a bottom of said impeller housing and connected to a trailing end of the intake grate, said trim adjustable ride plate having a middle mounted on the stator side of the nozzle, and said trim adjustable trim plate being positioned under the impeller and in trailing relation to the tunnel;

said trailing end of said trim adjustable ride plate being substantially flush with a trailing end of a rudder;

said trim adjustable ride plate having a longitudinal axis of symmetry coincident with a longitudinal axis of symmetry of said hull;

whereby said trim adjustable ride plate protects said impeller from being hit by obstacles in the water and reduces water drag.

7. The watercraft of claim 6, further comprising:

a plurality of washers disposed between said trim adjustable ride plate and the nozzle;

said washers having a collective thickness that changes the inclination of said trim adjustable ride plate, thereby changing the trim angle of the watercraft;

whereby reducing the number of washers raises the trailing end of the trim adjustable ride plate, thereby lowering the stern and raising the bow when the watercraft is in motion;

whereby increasing the number of washers lowers the trailing end of the trim adjustable ride plate, thereby raising the stern and lowering the bow when the watercraft is in motion.

* * * * *